United States Patent [19]

Henault

[11] 3,980,063

[45]*Sept. 14, 1976

[54] DEVICES FOR RECIRCULATING EXHAUST GASES IN INTERNAL COMBUSTION ENGINES

[75] Inventor: Claude Hénault, Billancourt, France

[73] Assignees: Regie Nationale des Usines Renault; Automobiles Peugeot, both of France

[ * ] Notice: The portion of the term of this patent subsequent to Sept. 14, 1991, has been disclaimed.

[22] Filed: June 1, 1971

[21] Appl. No.: 148,329

[30] Foreign Application Priority Data

June 12, 1970 France ..... 70.21640
Nov. 26, 1970 France ..... 70.42529

[52] U.S. Cl. ..... 123/119 A; 173/179 G
[51] Int. Cl.[2] ..... F02M 25/06
[58] Field of Search ..... 123/119 A, 179 G

[56] References Cited

UNITED STATES PATENTS

| | | | |
|---|---|---|---|
| 2,287,593 | 6/1942 | Ball | 123/119 A |
| 2,317,582 | 4/1943 | Bicknell | 123/119 A |
| 2,408,846 | 10/1946 | Golden et al. | 123/119 A |
| 3,621,825 | 11/1971 | Ojala | 123/119 A |
| 3,636,934 | 1/1972 | Nakajima et al. | 123/119 A |

FOREIGN PATENTS OR APPLICATIONS

| | | | |
|---|---|---|---|
| 27,865 | 5/1924 | France | 123/119 A |

*Primary Examiner*—Wendell E. Burns
*Attorney, Agent, or Firm*—Stevens, Davis, Miller & Mosher

[57] ABSTRACT

The invention is directed to means for improving the operating conditions of internal combustion engines by the selective recirculation of exhaust gases as a function of the different engine speeds. More particularly, the exhaust gases are recirculated when starting the engine, during the period preceding the actual ignition, during low engine speed periods corresponding to a considerable and pre-adjusted induction vacuum, and also when the engine is operating under full-load conditions, the recirculation being discontinued at the other engine speeds, to reduce the atmospheric pollution and improve the engine performances.

3 Claims, 2 Drawing Figures

DEVICES FOR RECIRCULATING EXHAUST GASES IN INTERNAL COMBUSTION ENGINES

Figure 1:
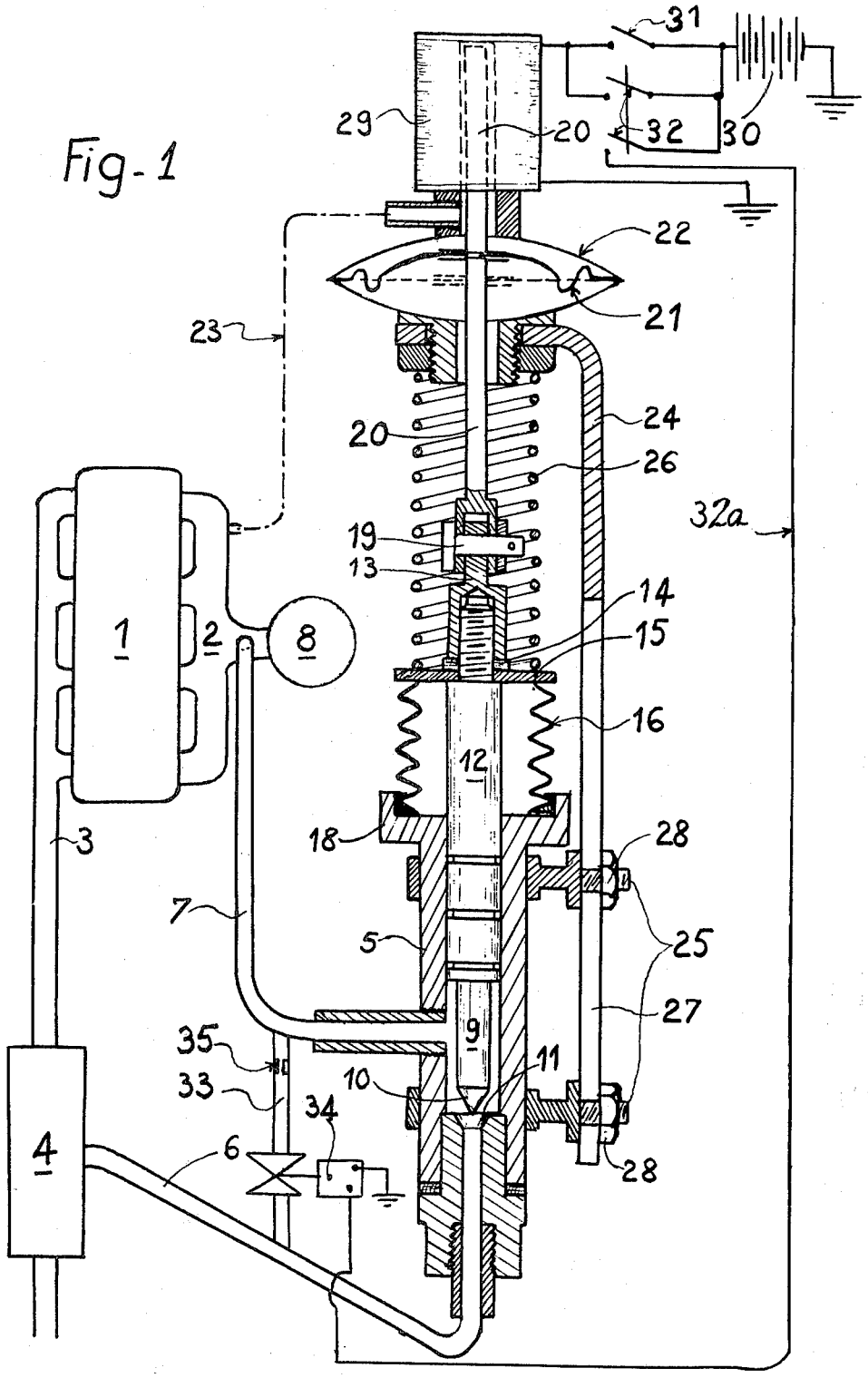

The present invention relates to the treatment of combustion mixtures of internal combustion engines and more particularly to a method of producing the partial and selective recirculation of exhaust gases towards the induction pipe of an I.C. engine with a view to improving its cold-starting conditions and high-speed operation, while reducing atmospheric pollution by nitrogen oxides at transient engine speeds.

At present internal combustion engines are started by enriching the carburetted mixture in order to produce a sufficient vaporization permitting its inflammation or ignition either by compression or by spark ignition.

In very cold weather, this vaporization is not sufficient for reaching the lower inflammability threshold. Liquid fuel deposits prevent the spark from occurring and the excessive richness of the air-fuel mixture is a serious cause of atmospheric pollution when starting the engine.

On the other hand, the beneficial influence exerted by a partial recirculation of exhaust gases in the reduction of the nitrogen oxide content thereof at certain intermediate engine speeds is well known; however, it is also known that these gases have a detrimental influence on the engine power output at high engine speeds, and also at starting and idling speeds, due to the loss of power, irregular operation and the propensity to stall resulting from the presence of these gases.

In view of the foregoing, various attempts have been made for the purpose of recirculating the exhaust gas of I.C. engines by controlling the output of this gas either as a function of load or as a function of engine speed, and also as a function of the throttle position or of the carburetor suction or depression. Since simple devices are only partially operative and have a poor sensitivity, most of the prior art propositions are costly and complicated; besides, their operation and adjustment are delicate and uncertain, due to the exhaust gas temperature and the corrosion and fouling effect observed on the parts exposed to the action of these gases. Under these conditions, none of these recirculation systems has really been produced and marketed on a large scale.

It is the essential object of the present invention to provide a method of selectively recirculating exhaust gases at certain engine speeds, from a distributor valve of relatively simple design, adapted to open or close at these various and predetermined engine speeds, according to pre-adjusted throttle opening or output values and under the action of various control means.

More particularly, this method is characterized in that the exhaust gases are recirculated when starting the engine, during the period preceding the engine ignition, this circulation being discontinued by the closing of said valve when the ignition takes place and the engine is firing or running. The circulation is subsequently restored during low engine speed periods corresponding to a substantial, pre-adjusted induction suction, and also when the engine is operated under full-load conditions, i.e. when the carburetor throttle is fully open, the exhaust gas recirculation valve being otherwise kept closed outside these various engine operating speeds.

This method of recirculating exhaust gases is attended by a substantial improvement in the engine running conditions while reducing atmospheric pollution, which constituted heretofore rather contradictory requirements.

Regarding the cold starting operation it is known in fact that modern fuels contain a number of component elements easily oxidizable at low temperature and under low pressure. In the device according to the present invention, the air-fuel mixture is compressed and recycled without combustion during the period in which the starter motor is energized. An oxidation of the recycled mixture takes place until, the time factor having replaced the temperature factor for producing the pre-oxidation of the mixture, the ignition eventually takes place. Since a longer time was available for producing its oxidation, notably for the component elements tending to oxidize at low temperature, this mixture will generally be ignited at the second compression.

As a result, any device for enriching the mixture when starting the engine can be dispensed with and consequently the considerable atmospheric pollution produced by this device is safely eliminated.

As soon as the engine fires, the normal de-energization of the starter motor causes the exhaust gas recirculation valve to close and thus discontinue the exhaust gas recycling. Then the engine operates normally with its conventional carburetion system, without hunting or undergoing any loss of power by which this hunting is usually attended at starting and idling engine speeds, thus reducing considerably the engine tendency to stall.

At transient engine speeds such as low speeds, it is well known that the addition of exhaust gases to the combustion mixture with a view to reducing the nitrogen oxide content is rather detrimental. Under these conditions, the exhaust gas recirculation valve will gradually open under the control of the induction, and this recirculation will be restored above a predetermined threshold of the induction vacuum value.

By re-opening the aforesaid recirculation valve when accelerating at high engine speeds corresponding to full load operation, i.e. with the accelerator pedal fully depressed, the carburetor throttle is of course fully open, so that the tendency of the engine to knock is eliminated, thus affording an unexpected improvement in the engine performances.

In fact, it is known that at these high speeds the oxidation reactions due to certain chemical substances contained in the hydrocarbons, under the combined influence of pressure and heat, are conductive to the so-called detonation phenomenon or auto-ignition or self-ignition effect.

At a proper time, beyond a predetermined engine load, the exhaust gas recirculation will be restored towards the suction or induction manifold. This gas will consist of a previously burnt mixture which exerts on the cold mixture delivered to the combustion chambers an action capable of positively preventing the occurrence of the aforesaid detonation phenomenon.

This application of the exhaust gas recycling during the engine operation at high speed is based, according to another feature characterizing this invention, on the unexpected result that if the recycled exhaust gas increases the temperature of the induction mixture, thus permitting the detonation, the reduction in the partial pressure of the unburnt mixture and the dilution thereof with the recycled mixture lead to an elimination of said detonation, and this elimination appears to be preponderant, so that the conditions of operation at high engine speeds are improved considerably.

In order to obtain recirculation gas outputs consistent with the various conditions of operation of the engine, the following measures must be taken:

- When starting the engine, the recirculation control valve must be fully open by means of an electromagnet energized under the control of the starter motor switch.
- During the engine operation at intermediate speeds, the same valve must be more or less open, under the control of a diaphragm responsive to the engine vacuum or depression.
- When the engine operates at full load, the valve must be again fully opened by the action of said electromagnet, but in this case its energization will be caused by a contact adapted to be closed when the carburetor throttle is fully open, this position corresponding to full load engine operation. Possibly, for obtaining a greater output, a second electromagnetcontrolled valve, adapted to open a second auxiliary recirculation circuit, will be actuated in parallel by the same control means from a double-contact switch.

Figure 2:
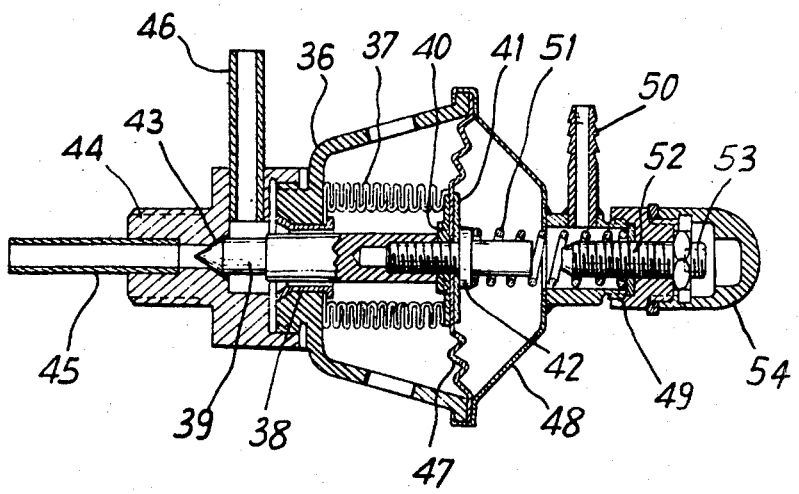

The method of this invention and two typical forms of embodiment of the valve means required for carrying out said method will now be described by way of illustration with reference to the accompanying drawing, in which:

FIG. 1 is an axial sectional view of an exhaust gas recirculation control valve with the various conduits leading to and from said valve; and FIG. 2 is an axial section showing a modified form of embodiment of the recirculation control valve.

The valve illustrated in FIG. 1 is shown on a larger scale with respect to the other component elements of the diagram, such as engine, battery, mufflers, etc.. in order clearly to show its constructional details.

In this diagram the engine 1, having an induction manifold 2, comprises an exhaust manifold 3 connected to an exhaust muffler 4.

The exhaust gas recirculation control valve 5 is constantly connected to the exhaust or expansion muffler 4 via a pipe 6, on the one hand, and to the induction manifold 2 via another pipe 7 opening into said manifold 2 downstream of the carburetor 8.

A needle valve 9 slidably mounted in the body of valve 5 is adapted to close the communication between said pipes 6 and 7 when its tapered point 10 engages the corresponding tapered seat 11.

The guide shank 12 of this needle valve 9 comprises a screw-threaded male end portion opposite to said tapered point 10, which is engaged by a tapped connecting socket 13 adapted, by engaging a gasket 14, to seal the joint between this shank 12 and the base 15 of a flexible metal bellows 16 surrounding said sliding shank 12.

The other end of the flexible metal bellows 16 is secured by cementing, welding, soldering, crimping or any other suitable means to a cup-shaped base 18 of valve body 5.

A transverse pin 19 connects the socket 13 to the control rod 20 attached to the central portion of a diaphragm 21 enclosed in a vacuum case 22 connected via a pipe line 23 either directly to the suction in induction manifold 2 or to the vacuum side of the ignition timing diaphragm associated with the distributor (not shown).

The vacuum diaphragm case 22 is rigidly mounted to a vertically adjustable bracket 24 rigidly connected by means of clamping collars 25 to the valve body 5. The support 24 is adjusted by releasing clamping nuts 28, selecting its proper vertical position and re-tightening said nuts 28. Thus, this adjustment permits accurate setting of the degree of prestress of a compression spring 26 normally urging the needle valve 9 of valve assembly 5 to its closed position.

The control rod 20 extends upwards beyond the diaphragm 21 of vacuum case 22, inside an electromagnet coil 29 mounted behind the case 22 and coaxially thereto. Upon energization of this coil 29 a direct impulse will be applied to the rod 20 and thus the valve 5 may be opened 5 independently of the opening by vacuum diaphragm 22.

The coil 29 inserted in the circuit of a battery 30 is adapted to be energized by means of a pair of parallel-mounted switches 31 and 32.

Switch 31 constitutes the starting switch. Switch 32 is closed when the accelerator pedal is depressed to a degree corresponding to full-load engine operation.

In case an additional exhaust gas recirculation, as shown in broken lines in the diagram, via a pipe 33 connected in parallel to pipes 6 and 7, was deemed necessary, a double switch 32 will be used to control simultaneously, via the parallel connection **32*a*, the opening of a solenoid-operated valve 34 inserted in pipe line 33, the permissible throughput of said pipe line 33 being pre-adjusted by means of a calibrated output device or jet 35**.

An obvious advantageous feature of this assembly is its inherent simplicity; it is easy to adjust and since it operates as a "hit-or-miss" device it is free of any misadjustment. The valve 5 is made completely fluid-tight by the presence of bellows 16. Consequently, it is possible with this assembly to apply the method of this invention to any existing engine at a relatively low cost.

During the operation, closing the starter motor switch 31 causes the energization of coil 29 and therefore the pulling of control rod 20, thus compressing the spring 26 and unseating the needle valve 9; consequently, pipe lines 6 and 7 are interconnected, thus producing a partial recirculation of the still unburnt combustion mixture. When the engine has been started and begins to fire, the opening of the starter motor switch 31 will de-energize the coil 29 and the return spring 26 will seat again the needle valve 9 of valve unit 5.

During the starting period and also during idling periods, the depression will not be sufficient to open the valve 5 through the action of vacuum case 22. Therefore, the recirculation of exhaust gas is discontinued. It will be restored only when a predetermined engine speed threshold corresponding to a higher vacuum in the induction manifold 2, is overstepped, this threshold being adjusted as a function of the compression of spring 26 counter-balancing this vacuum.

The action of spring 26 becomes again preponderant and valve 5 is reclosed, except during full-load engine operation periods, i.e. when engine knock is most likely to occur. During these periods, the accelerator pedal is depressed down and therefore switch 32 is closed, together with valve 34 if an additional recirculation circuit is provided, whereby the recirculation of exhaust gas permits the elimination of engine knock as already explained hereinabove. Releasing the accelerator pedal will reduce the load and therefore cut off again the exhaust gas recirculation.

From the foregoing it will be seen that with the method of selectively recirculating exhaust gases according to this invention and with the simple exemplary form of embodiment of the invention described hereinabove it is possible to utilize these gases for supplying the engine, throughout the range of its operating conditions, and only in well-defined cases, i.e. when the influence exerted by these gases is capable of improving the engine operation for different, well-known or novel reasons, while eliminating their detrimental effect under other engine operating conditions.

FIG. 2 illustrates essentially an economical construction of a simplified recirculation valve controlled by the manifold depression alone, the electromagnetic control contemplated in the preceding case being provided separately.

This valve comprises a body 36 in which a flexible bellows 37 has its ends connectd in fluid-tight. One end is connected with the body by means of a clamping ring 38 and the other end is connected with an internal needle valve 39 through the medium of washers 40, 41 clamped by an end screw 42. The needle valve 39 extends with play through the ring 38 and is adapted to engage a corresponding seat 43 formed in an end socket 44 screwed to said body 36. This end socket 44 comprises a pipe 45 extending axially therefrom and coaxially to the tapered seat 43 and adapted to be connected to the exhaust gas expansion muffler (not shown) constantly connected to the engine exhaust manifold.

This modified device further comprises a radial pipe 46 opening into the inner chamber of the valve which is formed about the needle valve 39 by the socket 44, the body 36 and bellows 37, this radial pipe 46 being adapted to be connected to the induction manifold of the engine, downstream of the carburetor throttle.

The needle valve 39 is assembled jointly with the bellows 37 and with a diaphragm 47 clamped between the aforesaid washers 40, 41 and constituting a vacuum chamber with the cover 48 clamping same along its outer peripheral edge to the body 36.

Secured to the cover 48 is a socket 49 provided with a radial pipe 50 also adapted to be connected to the induction manifold of the engine downstream of the carburetor throttle either directly or through the intermediary of the automatic vacuum timing or advance control suction chamber of the ignition distributor. Disposed between this socket 49 and the assembling screw 42 is a calibrated valve spring 51 constantly urging the needle valve 39 to its seated or closed position. In the bottom of the socket 49 is another screw 52 constituting an abutment for adjusting the permissible opening stroke of needle valve 39 and provided externally of said socket with a lock nut 53 covered by a screw cap 54 adapted to be screwed to a male screw-threaded portion of said socket 49.

This modified construction is advantageous notably in that the necessary component elements are assembled within relatively reduced over-all dimensions while safely protecting the fragile members such as the bellows and the diaphragm from external contacts and shocks. Moreover, from the functional point of view, in this modified form of embodiment the needle valve 39 can be of the "floating" type, i.e. mounted without any sliding fit in the valve body, thus eliminating any risk of jamming by dirt, soot or other causes, the ring 38 surrounding to this end the needle valve 39 with a sufficiently ample clearance. Finally, the adjustment means contemplated in this alternate form of embodiment is particularly easy to construct and operate.

What is claimed as new is:

1. An exhaust gas recirculation control device for an internal combustion engine comprising an induction manifold, an exhaust gas expansion muffler, recirculation means interconnecting said muffler and said manifold for recirculating the exhaust gas, at least one recirculation control valve inserted in said recirculation means, electromagnetic means for actuating said valve, vacuum means for actuating said valve, a starter motor swtich, a switch responsive to full-load conditions of the engine, said starter motor switch being electrically connected with said electromagnetic means so as to cause the full opening of said valve when starting the engine during the period preceding the engine firing, said switch responsive to full-load conditions being electrically connected with said electromagnetic means so as to cause the full opening of said valve at full-load conditions of the engine, and said vacuum means being connected to said induction manifold so as to cause a variable opening of said valve when the induction vacuum exceeds a pre-adjusted value.

2. An exhaust gas recirculation control device according to claim 1 further including a pipe connected in parallel with said recirculation means to said recirculation control valve, a solenoid-operated valve inserted in said pipe, said solenoid-operated valve being electrically connected with said switch responsive to full-load conditions so as to cause the opening of said solenoid-operated valve at full-load conditions of the engine.

3. An exhaust gas recirculation control device according to claim 1 wherein said recirculation control valve includes a body, said body having a flexible bellows as a wall, and a needle valve mounted in said body within said flexible bellows; a control rod connected to said needle valve, said control rod forming part of said electromagnetic means and said vacuum means; a common support provided for said recirculation control valve and said electromagnetic and vacuum means; and a variable prestressing compression spring interposed between said support and said needle valve.

* * * * *